US008901840B2

(12) United States Patent
Zhang et al.

(10) Patent No.: US 8,901,840 B2
(45) Date of Patent: Dec. 2, 2014

(54) LAMP IGNITION SYSTEM AND LAMP IGNITION METHOD

(75) Inventors: Wei-Qiang Zhang, Taoyuan Hsien (TW); Xiao-Peng Wang, Taoyuan Hsien (TW); Jian-Ping Ying, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 204 days.

(21) Appl. No.: 13/614,678

(22) Filed: Sep. 13, 2012

(65) Prior Publication Data

US 2014/0015434 A1 Jan. 16, 2014

(30) Foreign Application Priority Data

Jul. 16, 2012 (CN) ..... 2012 1 0245890

(51) Int. Cl.
*H05B 41/24* (2006.01)
*H05B 41/18* (2006.01)

(52) U.S. Cl.
USPC ..... 315/224; 315/219; 315/276

(58) Field of Classification Search
USPC ..... 315/224, 219, 276, 287, 354
See application file for complete search history.

(56) References Cited

U.S. PATENT DOCUMENTS

2008/0157692 A1* 7/2008 Ichikawa et al. ..... 315/219
2010/0176739 A1* 7/2010 Naruo ..... 315/276

FOREIGN PATENT DOCUMENTS

| | | |
|---|---|---|
| JP | 6288295 | 4/1987 |
| JP | 03056073 | 3/1991 |
| JP | 08008074 | 1/1996 |
| JP | 2001157456 | 6/2001 |
| JP | 2005033881 | 2/2005 |
| JP | 2006339149 | 12/2006 |
| JP | 2008226490 | 9/2008 |
| JP | 2010073556 | 4/2010 |
| JP | 2010272338 | 12/2010 |
| WO | 2009130994 A1 | 10/2009 |

* cited by examiner

*Primary Examiner* — Daniel D Chang
(74) *Attorney, Agent, or Firm* — CKC & Partners Co., Ltd.

(57) ABSTRACT

A lamp ignition system and a lamp ignition method are disclosed, where the lamp ignition system includes a converter, a transformer and a driving circuit. The converter converts an input voltage into an operating voltage for a gas discharge lamp. The transformer has a primary winding and a secondary winding, and the secondary winding is connected to the gas discharge lamp in series. The driving circuit is electrically connected to the primary winding for driving the transformer, so that the secondary winding of the transformer can output a high-frequency voltage to ignite the gas discharge lamp.

25 Claims, 4 Drawing Sheets

LAMP IGNITION SYSTEM AND LAMP IGNITION METHOD

CROSS REFERENCE TO RELATED APPLICATIONS

This application claims priority to China Application Serial Number 201210245890.3, filed Jul. 16, 2012, which is herein incorporated by reference in its entirety.

BACKGROUND OF THE INVENTION

1. Technical Field

The present disclosure relates to electronic technology, and more particularly, to a lamp ignition system and a lamp ignition method.

2. Description of Related Art

FIG. 1 is a circuit block diagram of a conventional gas-discharge lamp system 100. As shown in FIG. 1, a converter 110 converts an input voltage Vin into an operating voltage for a DC HID (High Intensity Discharge) lamp, and a high voltage generator 120 generates a high DC voltage for igniting this lamp, in which the driving circuit 121 drives the transformer T1 for outputting high-voltage pulses to a diode D9 and a capacitor C9, so as to supply a DC voltage (1.5 kV) across the lamp 130. The high-voltage diode D2 can prevent the DC voltage from damaging other components of the converter 110. Generally, a forward voltage drop of the high-voltage diode D2 is relatively high. Before the lamp 130 is ignited, no current flows through the high-voltage diode D2, and therefore no loss occurs. After the lamp 130 is ignited, a lamp current flows through the high-voltage diode D2 to produce large steady-state loss, and therefore the efficiency of the ballast is reduced, where waveforms of a lamp voltage and the lamp current are shown in FIG. 2.

In view of the foregoing, there still exist some inconveniences and defects in conventional designs for lamp ignition that await further improvement. However, those skilled in the art sought vainly for a solution. In order to solve or circumvent above problems and disadvantages, there is an urgent need in the related field to improve system efficiency.

SUMMARY OF THE INVENTION

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

In one or more various aspects, the present disclosure is directed to a lamp ignition system and a lamp ignition method, so as to improve system efficiency.

According to one embodiment of the present invention, a lamp ignition system includes a converter, a transformer and a driving circuit. The converter converts an input voltage into an operating voltage suitable for a gas discharge lamp. The transformer has a primary winding and a secondary winding, where the secondary winding is connected to the gas discharge lamp in series. The driving circuit is electrically connected to the primary winding for driving the transformer in a lamp ignition stage, so that the secondary winding of the transformer can output a high-frequency voltage to ignite the gas discharge lamp.

According to another embodiment of the present invention, a lamp ignition method includes steps of (a) converting an input voltage into an operating voltage suitable for a gas discharge lamp, where the gas discharge lamp is connected to a secondary winding of a transformer in series; (b) driving the transformer in a lamp ignition stage, so that a secondary winding of the transformer can output a high-frequency voltage to ignite the gas discharge lamp.

Technical advantages are generally achieved, by embodiments of the present invention. In present invention, the winding of the transformer is connected to the gas discharge lamp (e.g., the direct-current lamp) in series, so that the high-voltage diode D2 in conventional art can be removed from the system, and therefore the loss that results form the high-voltage diode D2 can be circumvented.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawing, wherein.

DETAILED DESCRIPTION OF THE INVENTION

Figure 1:
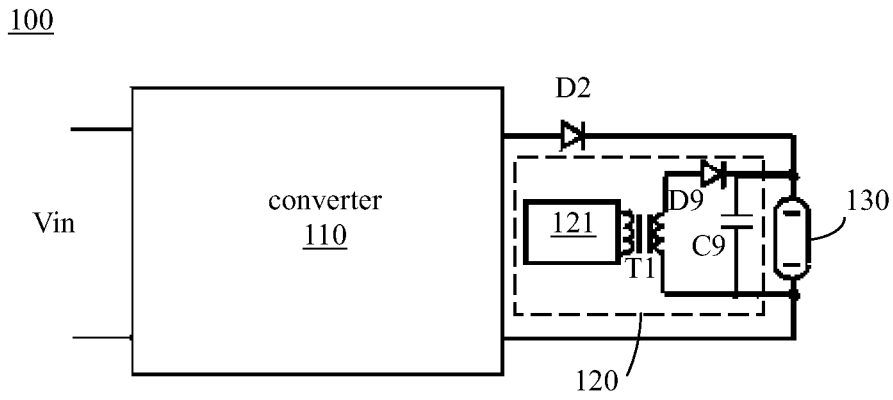
FIG. 1 (PRIOR ART)
FIG. 1 is a circuit block diagram of a conventional gas-discharge lamp system.
Figure 2:
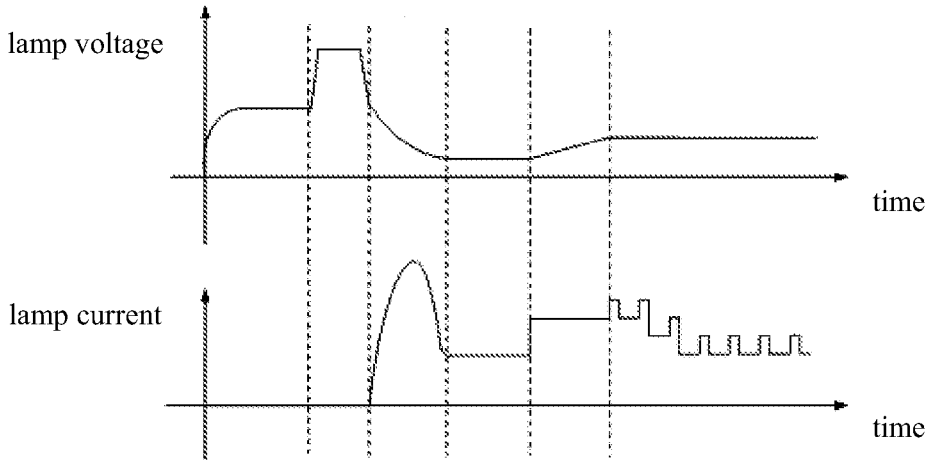
FIG. 2 (PRIOR ART)
FIG. 2 is a waveform diagram of a lamp voltage and a lamp current of the gas-discharge lamp system of FIG. 1.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
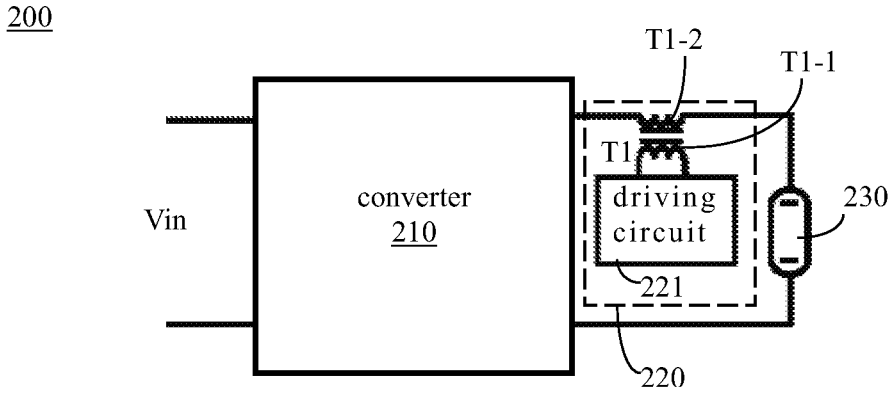
FIG. 3 is a circuit block diagram of a lamp ignition system according to one embodiment of the present disclosure.

In one aspect, the present disclosure is directed a lamp ignition system for improving system efficiency. Referring to FIG. 3, illustrated is a circuit block diagram of a lamp ignition system 200 according to one embodiment of the present disclosure. This system may be easily inserted into ballast and may be applicable or readily adaptable to all technologies.

The lamp ignition system 200 includes a converter 210, a high voltage generator 220 and a gas discharge lamp 230. The high voltage generator 220 includes a transformer T1 and a driving circuit 221. The transformer T1 has a primary winding T1-1 and a secondary winding T1-2, where the primary winding T1-1 is electrically connected to the driving circuit 221, and the secondary winding T1-2 is connected to the gas discharge lamp 230 in series. In the following description, the gas discharge lamp is a direct-current (DC) lamp for example. The converter 210 may be a DC-DC converter or an AC-DC converter. The DC-DC converter, such as Buck, Flyback, Forward, Speic, Cuk, etc., converts input DC voltage Vin into the operating voltage for the DC lamp 230. The AC-DC converter converts input AC voltage Vin into the operating voltage for the DC lamp 230. In should be noted that the winding of the transformer T1 in the high voltage generator 220 is connected to the DC lamp 230 in series, so that the high-voltage diode D2 in conventional art can be removed from the system, and therefore the loss that results form the high-voltage diode D2 can be circumvented. Thus, the system efficiency is increased dramatically In FIG. 4, the converter 210 is a buck converter circuit. The buck converter circuit includes a capacitor C1, an inductor L1, a resistor Rcs, a freewheeling diode D1 and a control switch Q1.

Figure 4:
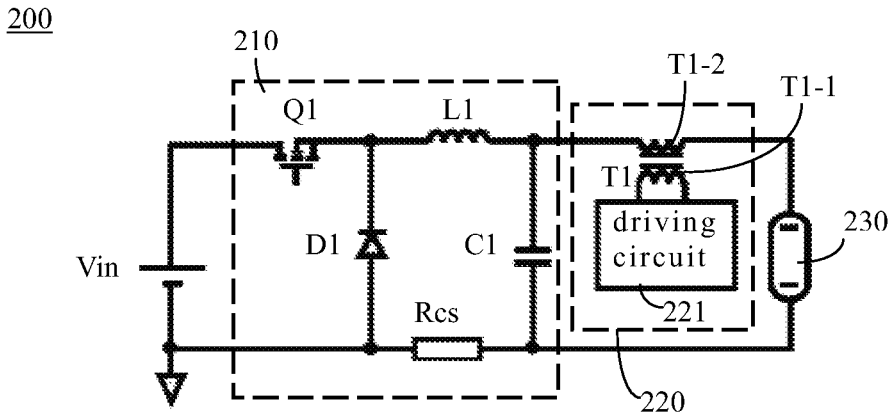
FIG. 4 is a circuit block diagram of the lamp ignition system according to another embodiment of the present disclosure.

One terminal of the capacitor C1 is electrically connected to the secondary winding T1-2 of the transformer T1, and another terminal of the capacitor C1 is electrically connected to the DC lamp 230. The inductor L1 is electrically connected to the secondary winding T1-2 of the transformer T1. The resistor Rcs is electrically connected to the DC lamp 230. The anode of the freewheeling diode D1 is electrically connected to the resistor Rcs, and the cathode of the freewheeling diode D1 is electrically connected to the inductor L1. One end of the control switch Q1 is electrically connected to the cathode of the freewheeling diode D1, and another end of the control switch Q1 is electrically connected to the input voltage Vin. In FIG. 4, the control switch Q1 is a metal oxide semiconductor field effect transistor (MOSFET), and a controller can control an on/off state of the MOSFET.

When lamp ignition system 200 operates, the converter 210 converts the input voltage Vin into the operating voltage for the DC lamp 230, and the driving circuit 221 drives the transformer T1 in a lamp ignition stage, so that the secondary winding T1-2 of the transformer T1 can output a high-frequency voltage. Referring to a loop composed of the capacitor C1, the secondary winding T1-2 of the transformer T1 and the DC lamp 230, a voltage drop across the capacitor C1 is very low, and most of high-frequency voltage is applied to the DC lamp 230, so that the DC lamp 230 can be ignited.

After the DC lamp 230 has been ignited, the driving circuit 221 stops working, and a lamp current flow through the secondary winding T1-2. Referring to the design formula of magnetic device: L*I=N*B*Ae, if the transformer T1 operates in an unsaturated state after the DC lamp 230 has been ignited, the number of turns N is more, and therefore loss of the wiring will increase and the efficiency decreases accordingly. In this embodiment, the transformer T1 operates in an unsaturated state during the lamp ignition stage, and a designer can choose the number of turns of the wiring depending on the requirements for outputting high voltage; in steady operation, the transformer T1 operates in a saturated state. Thus, the number of turns of the secondary winding T1-2 is relatively less. Moreover, the current flowing through the secondary winding T1-2 is a DC current. Even if the transformer T1 operates in the saturated state, the loss of the transformer T1 still remains very low. In such design, the number of turns of the secondary winding T1-2 is less, and therefore after the DC lamp 230 is ignited, the loss of the secondary winding T1-2 is reduced. For example, when a HID lamp (240 W) is ignited, the system efficiency is improved at least 1.4%, as compared with the conventional art.

Figure 5:
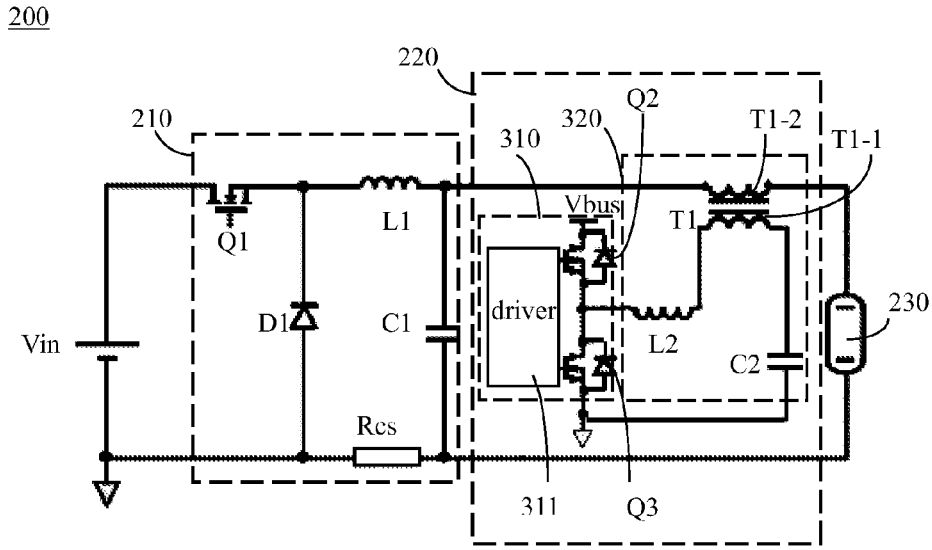
FIG. 5 is a circuit block diagram of the lamp ignition system according to yet another embodiment of the present disclosure.

For a further understanding of the above driving circuit, refer to FIG. 5, the half bridge circuit 310 and a resonant circuit 320 constitute the high voltage generator 220, in which an inductance L2, a capacitor C2 and the transformer T1 constitute the resonant circuit 320. The resonant circuit 320 is electrically connected to the half bridge circuit 310. The inductance L2 and the capacitor C2 are connected to two ends of the primary winding T1-1 of the transformer T1, respectively. The inductance L2 may be an added inductor, a leakage inductance of the transformer T1, or the combination thereof.

The half bridge circuit 310 includes a first switch Q2, a second switch Q3 and a driver 311. The first switch Q2 and the second switch Q3 are connected in series, where the first switch Q2 is connected to a voltage source Vbus, and the second switch Q3 is grounded. The driver 311 is electrically connected to respective control terminals of the first and second switches Q2 and Q3. In FIG. 5, the first switch Q2 and the second switch Q3 are two metal oxide semiconductor field effect transistors(MOSFET), and each MOSFET may have a body diode.

The voltage source Vbus can be the input voltage Vin, the voltage across the capacitor C1 or an external voltage source.

In use, the driver 311 can control the first and second switches Q2 and Q3 to operate alternately. The working frequency of the first and second switches Q2 and Q3 is 10-500 kHz, so that resonant circuit 320 can resonate, and therefore the secondary winding T1-2 of the transformer T1 can output the high-frequency voltage as an ignition voltage.

Figure 6:
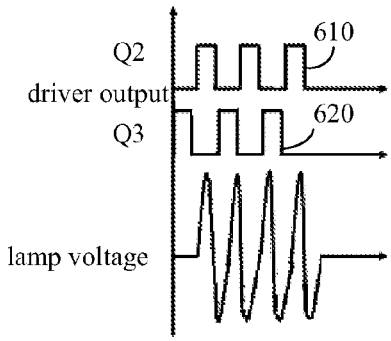
FIG. 6 is a waveform diagram of the lamp ignition system of FIG. 5 in a symmetric driving manner.
Figure 7:
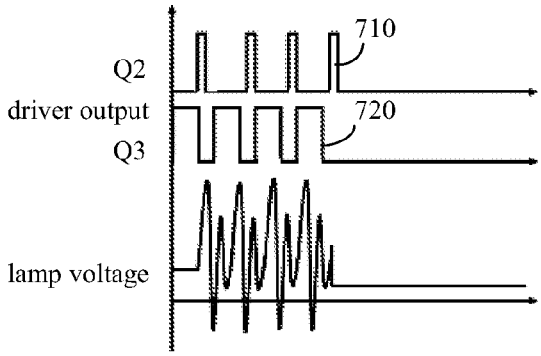
FIG. 7 is a waveform diagram of the lamp ignition system of FIG. 5 in an asymmetric driving manner.

FIG. 6 and FIG. 7 are respective waveform diagrams of the high voltage generator of FIG. 5. As shown in FIG. 6, the first and second switches Q2 and Q3 are controlled in a symmetric driving manner. In the symmetric driving manner, the driver 311 outputs a first pulse 610 to the first switch Q2 and a second pulse 620 to the second switch Q3 alternately, wherein a width of the first pulse 610 is equal to a width of the second pulse 620, and a corresponding voltage applied to the DC lamp is a symmetric high-frequency ignition voltage. Alternatively, as shown in FIG. 7, the first and second switches Q2 and Q3 are controlled in an asymmetric driving manner. In the asymmetric driving manner, the driver 311 outputs a first pulse 710 to the first switch Q2 and a second pulse 720 to the second switch Q3 alternately, wherein a width of the first pulse 610 is different from a width of the second pulse 620, and a corresponding voltage applied to the DC lamp is an asymmetric high-frequency ignition voltage.

Figure 8:
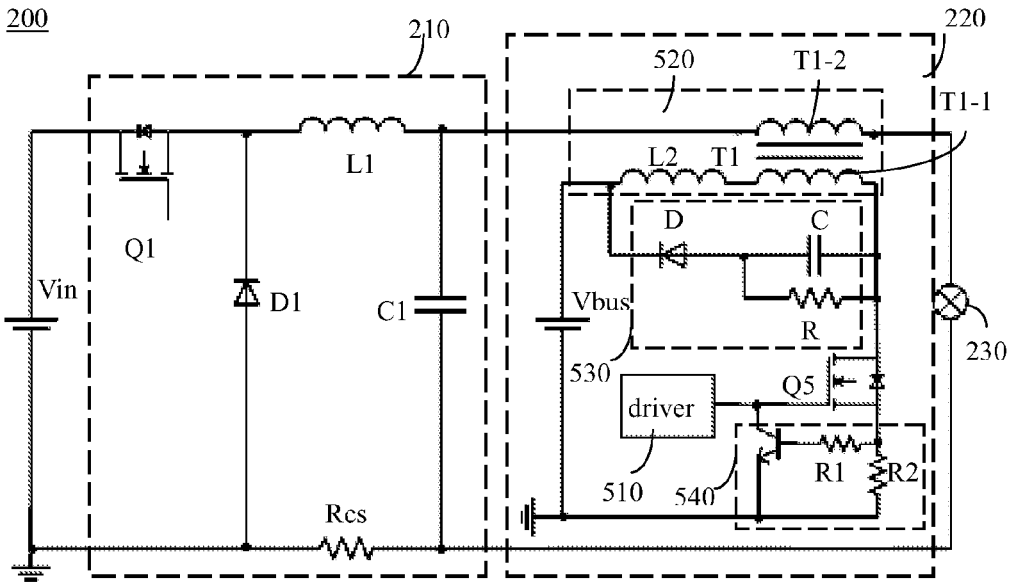
FIG. 8 is a circuit block diagram of the lamp ignition system according to still yet another embodiment of the present disclosure.

Alternatively, as shown in FIG. 8, the driving circuit includes an inductance L2, a switch device Q5 and a driver 510. The inductance L2 is electrically connected to the primary winding T1-1 of the transformer T1 and a voltage source Vbus, where the transformer T1 has parasitic capacitance. The driver 510 controls an on/off state of the switch device Q5. In FIG. 8, the switch device Q5 is a metal oxide semiconductor field effect transistor.

Figure 9:
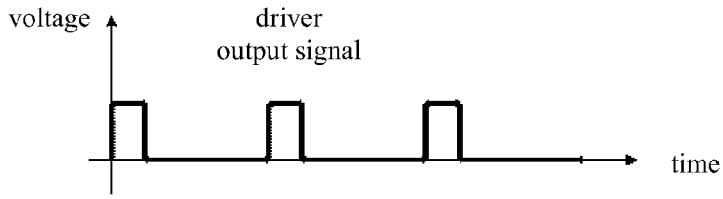
FIG. 9 is a waveform diagram of an output signal of a driver of FIG. 8.
Figure 10:
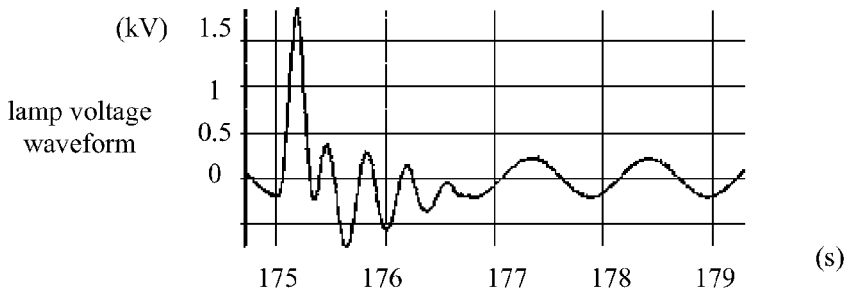
FIG. 10 is a waveform diagram of the lamp voltage of the lamp ignition system of FIG. 8.

In use, the driver 510 outputs a high-frequency driving signal to turn on the switch device Q5, and then the inductance L2 and the transformer T1 including the parasitic capacitance constitute a resonant circuit 520, and the secondary winding T1-2 can output the ignition voltage. The working frequency of the switch device Q5 is 10-500 kHz, and the duty ratio of the switch device Q5 is 0.2%-10%, as shown in FIG. 9. For the performance of the driver, the working frequency of the switch device Q5 is 200 kHz, and the duty ratio is 3%, so as to select a low-cost driver chip and further reduce the volume of the transformer T1. Moreover, the inductance L2 may be an added inductor, a parasitic inductance of the transformer T1, or the combination thereof, and a waveform diagram of the lamp voltage is shown in FIG. 10.

The voltage source Vbus can be the input voltage Vin, the voltage across the capacitor C1 or an external voltage source. Those skilled in the art may choose a suitable voltage source depending on the desired application.

In one embodiment, the driving circuit further includes an absorbing circuit 530. The absorbing circuit 530 is electrically connected to the switch device Q5 and the resonant circuit 520. The absorbing circuit 530 includes a diode D, a capacitor C and a resistor R.

In one embodiment, the driving circuit further includes a current limit circuit 540. The current limit circuit 540 is electrically connected to the switch device Q5. The current limit circuit 540 includes a bipolar junction transistor (BJT) and resistors R1 and R2.

In use, the absorbing circuit 530 limits voltage applied to the switch device Q5 when the switch device Q5 is cut off. The current limit circuit 540 limits current flowing through the switch device Q5, so as to prevent the switch device Q5 from being damaged.

From the above, the present disclosure is directed to a lamp ignition method. This lamp ignition method includes steps of (a) converting an input voltage Vin into an operating voltage suitable for a gas discharge lamp, such as a DC lamp 230, where the DC lamp 230 is connected to a secondary winding T1-2 of a transformer T1 in series; (b) driving the transformer T1 in a lamp ignition stage, so that the secondary winding T1-2 of the transformer T1 can output a high-frequency voltage to ignite the DC lamp 230.

During the lamp ignition stage, the transformer T1 operates in an unsaturated state.

The lamp ignition method further includes a step of stopping driving the transformer T1 after the DC lamp 230 has been ignited, so that the transformer T1 operates in a saturated state.

In the lamp ignition method, as shown in FIG. 5, an inductance L2, a capacitor C2 and the transformer T1 constitute a resonant circuit 320, a half bridge circuit 310 includes a first switch Q2 and a second switch Q3 connected in series, and the step (b) includes: controlling the first and second switches Q2 and Q3 to operate alternately, so that the secondary winding T1-2 of the transformer T1 outputs the high-frequency voltage as an ignition voltage.

In one embodiment, the step of controlling the first and second switches Q2 and Q3 includes: outputting a first pulse 610 to the first switch Q2 and a second pulse 620 to the second switch Q3 alternately, wherein a width of the first pulse is equal to a width of the second pulse, and the lamp voltage of the DC lamp 230 is shown in FIG. 6.

In another embodiment, the step of controlling the first and second switches Q2 and Q3 includes: outputting a first pulse 710 to the first switch Q2 and a second pulse 720 to the second switch Q3 alternately, wherein a width of the first pulse is different from a width of the second pulse, and the lamp voltage of the DC lamp 230 is shown in FIG. 7.

In the lamp ignition method, as shown in FIG. 8, an inductance L2 and the transformer T1 having parasitic capacitance constitute a resonant circuit 520, a switch device Q5 is electrically connected to the resonant circuit 520, and the step (b) includes: controlling an on/off state of the switch device Q5, so that the secondary winding T1-2 of the transformer T1 outputs the high-frequency voltage as the ignition voltage.

In one embodiment, the lamp ignition method further includes a step of providing an absorbing circuit 530, which is electrically connected to the switch device Q5 and the resonant circuit 520, and limiting voltage applied to the switch device Q5 by use of the absorbing circuit 530 when the switch device Q5 is cut off.

Alternatively or additionally, the lamp ignition method further includes a step of providing a current limit circuit 540, which is electrically connected to the switch device Q5, and limiting current flowing through the switch device Q5 by use of the current limit circuit 540, so as to prevent the switch device Q5 from being damaged.

In above-mentioned lamp ignition method, the steps are not recited in the sequence in which the steps are performed. That is, unless the sequence of the steps is expressly indicated, the sequence of the steps is interchangeable, and all or part of the steps may be simultaneously, partially simultaneously, or sequentially performed. It should be noted that those implements to perform the steps in the lamp ignition method are disclosed in above embodiments and, thus, are not repeated herein.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims herein is not intended to invoke the provisions of 35 U.S.C. §112, 6th paragraph.

What is claimed is:

1. A lamp ignition system, comprising:

a converter for converting an input voltage into an operating voltage suitable for a gas discharge lamp;

a transformer having a primary winding and a secondary winding, wherein the secondary winding, the gas discharge lamp and the converter are connected in series; and a driving circuit electrically connected to the primary winding, for driving the transformer in a lamp ignition stage, so that the secondary winding of the transformer outputs a high-frequency voltage to ignite the gas discharge lamp.

2. The lamp ignition system of claim 1, wherein the gas discharge lamp is a direct-current lamp.

3. The lamp ignition system of claim 1, wherein during the lamp ignition stage, the transformer operates in an unsaturated state.

4. The lamp ignition system of claim 3, wherein after the gas discharge lamp has been ignited, the driving circuit stops working, so that the transformer operates in a saturated state.

5. The lamp ignition system of claim 1, wherein the driving circuit comprises:

an inductance and a capacitor connected to two ends of the primary winding of the transformer respectively, wherein the inductance, the capacitor and the transformer constitute a resonant circuit; and a half bridge circuit electrically connected to the resonant circuit.

6. The lamp ignition system of claim 5, wherein the half bridge circuit comprises:

a first switch and a second switch connected in series, wherein the first switch is connected to a voltage source, and the second switch is grounded; and a driver electrically connected to respective control terminals of the first and second switches, so that the driver controls the first and second switches to operate alternately.

7. The lamp ignition system of claim 6, wherein a working frequency of the first and second switches is 10-500 kHz.

8. The lamp ignition system of claim 6, wherein the voltage source is an input voltage of the converter, an output voltage of the converter or an external voltage source.

9. The lamp ignition system of claim 6, wherein the driver outputs a first pulse to the first switch and a second pulse to the second switch alternately, and a width of the first pulse is equal to or different from a width of the second pulse.

10. The lamp ignition system of claim 1, wherein the driving circuit comprises:

an inductance electrically connected to the primary winding of the transformer and a voltage source, wherein the inductance and the transformer having parasitic capacitance constitute a resonant circuit;

a switch device electrically connected to the resonant circuit; and a driver for controlling an on/off state of the switch device.

11. The lamp ignition system of claim 10, wherein the voltage source is an input voltage of the converter, an output voltage of the converter or an external voltage source.

12. The lamp ignition system of claim 10, wherein the driving circuit further comprises:

an absorbing circuit electrically connected to the switch device and the resonant circuit, for limiting voltage applied to the switch device when the switch device is cut off.

13. The lamp ignition system of claim 10, wherein the driving circuit further comprises:

a current limit circuit electrically connected to the switch device, for limiting current flowing through the switch device.

14. The lamp ignition system of claim 10, wherein a working frequency of the switch device is 10-500 kHz, and a duty ratio of the switch device is 0.2%-10%.

15. The lamp ignition system of claim 14, wherein the working frequency of the switch device is 200 kHz, and the duty ratio is 3%.

16. The lamp ignition system of claim 1, wherein the converter is a DC-DC converter or an AC-DC converter.

17. A lamp ignition method, comprising:

(a) converting an input voltage into an operating voltage suitable for a gas discharge lamp by utilizing a converter, wherein the gas discharge lamp, a secondary winding of a transformer and the converter are connected in series; and (b) driving the transformer in a lamp ignition stage, so that the secondary winding of the transformer outputs a high-frequency voltage to ignite the gas discharge lamp.

18. The lamp ignition method of claim 17, wherein the gas discharge lamp is a direct-current lamp.

19. The lamp ignition method of claim 17, wherein during the lamp ignition stage, the transformer operates in an unsaturated state.

20. The lamp ignition method of claim 19, further comprising:

stopping driving the transformer after the gas discharge lamp has been ignited, so that the transformer operates in a saturated state.

21. The lamp ignition method of claim 17, wherein an inductance, a capacitor and the transformer constitute a resonant circuit, a half bridge circuit electrically connected to the resonant circuit comprises a first switch and a second switch connected in series, and the step (b) comprises:

controlling the first and second switches to operate alternately, so that the secondary winding of the transformer outputs the high-frequency voltage.

22. The lamp ignition method of claim 21, wherein the step of controlling the first and second switches comprises:

outputting a first pulse to the first switch and a second pulse to the second switch alternately, wherein a width of the first pulse is equal to or different from a width of the second pulse.

23. The lamp ignition method of claim 17, wherein an inductance and the transformer having parasitic capacitance constitute a resonant circuit, a switch device is electrically connected to the resonant circuit, and the (b) comprises:

controlling an on/off state of the switch device, so that the secondary winding of the transformer outputs the high-frequency voltage.

24. The lamp ignition method of claim 23, further comprising:

providing an absorbing circuit electrically connected to the switch device and the resonant circuit, and limiting voltage applied to the switch device by the absorbing circuit when the switch device is cut off.

25. The lamp ignition method of claim 23, further comprising:

providing a current limit circuit electrically connected to the switch device, and limiting current flowing through the switch device by the current limit circuit.

* * * * *